US008141362B2

(12) United States Patent
Benstead et al.

(10) Patent No.: US 8,141,362 B2
(45) Date of Patent: Mar. 27, 2012

(54) CLOSED CYCLE HEAT TRANSFER DEVICE AND METHOD

(75) Inventors: Russell Benstead, Ellesmere Port (GB); Simon James Redford, Flintshire (GB)

(73) Assignee: Energetix Genlec Limited, Chester (GB)

( * ) Notice: Subject to any disclaimer, the term of this patent is extended or adjusted under 35 U.S.C. 154(b) by 543 days.

(21) Appl. No.: 12/421,892

(22) Filed: Apr. 10, 2009

(65) Prior Publication Data

US 2009/0211734 A1 Aug. 27, 2009

Related U.S. Application Data

(63) Continuation of application No. PCT/GB2007/003837, filed on Oct. 10, 2007.

(30) Foreign Application Priority Data

Oct. 12, 2006 (GB) ..... 0620201.4

(51) Int. Cl.
*F01K 23/04* (2006.01)

(52) U.S. Cl. ..... 60/655; 60/682

(58) Field of Classification Search ..... 60/655, 60/682, 683

See application file for complete search history.

(56) References Cited

U.S. PATENT DOCUMENTS

| | | | | |
|---|---|---|---|---|
| 3,830,259 | A | 8/1974 | Mercier | |
| 4,120,172 | A | 10/1978 | Pierce | |
| 4,341,202 | A | 7/1982 | French | |
| 5,272,878 | A * | 12/1993 | Schlichtig | 60/655 |
| 5,809,791 | A * | 9/1998 | Stewart, III | 62/115 |
| 7,942,001 | B2 * | 5/2011 | Radcliff et al. | 60/651 |
| 7,971,424 | B2 * | 7/2011 | Masada | 60/39.182 |
| 2003/0000213 | A1 * | 1/2003 | Christensen et al. | 60/670 |
| 2006/0065386 | A1 | 3/2006 | Alam | |

FOREIGN PATENT DOCUMENTS

| | | | |
|---|---|---|---|
| EP | 0000786 | A1 | 2/1979 |
| EP | 0212739 | A | 3/1987 |
| FR | 875664 | A | 9/1942 |
| JP | 03204600 | A | 6/1991 |
| JP | 06109382 | A | 4/1994 |
| JP | 09113160 | A | 5/1997 |
| JP | 11173781 | A | 7/1999 |
| JP | 2002016203 | A | 1/2002 |
| RU | 2120592 | A | 10/1998 |
| SU | 1779648 | A | 12/1992 |
| WO | 92/20972 | A | 11/1992 |

* cited by examiner

*Primary Examiner* — Hoang Nguyen
(74) *Attorney, Agent, or Firm* — Gesmer Updegrove LLP

(57) ABSTRACT

A closed cycle heat transfer device comprising a boiler (10) and a condenser (13), the condenser being used to recover useful heat by latent heat evaporation. A circuit defined by the boiler (10), condenser (13) and ducts (12, 15) is to be liquid-filled at a pressure just above atmospheric pressure. An expansion device (16) maintains the working pressure in the circuit but will receive excess condensate in a liquid phase to compensate for expansion of the working fluid vapor which passes from the boiler (10) to the condenser (13). The expansion chamber contains a movable or flexible member which, when working liquid is received in the chamber, is displaced to compress a gas in the chamber.

17 Claims, 4 Drawing Sheets

CLOSED CYCLE HEAT TRANSFER DEVICE AND METHOD

PRIORITY INFORMATION

This application is a continuation of International Application No. PCT/GB2007/003837 filed on Oct. 10, 2007 which claims priority to Great Britain Patent Application No. 0620201.4 filed on Oct. 12, 2006, all of which are incorporated by reference in their entirety herein.

BACKGROUND OF THE INVENTION

1. Field of the Invention

This invention concerns closed thermodynamic devices such as thermosyphons and heat pipes which are often found in many engineering applications such as the direct heating of a working fluid in an Organic Rankine Cycle.

2. Brief Description of the Prior Art

In such devices heat is transferred principally via latent heat evaporation. A fixed volume of heat transfer fluid within a closed system is vaporised by application of heat in an evaporator. Vapour then passes to a condenser where heat is transferred to some other process, the vaporised working fluid condensing against a cooling medium. Once the heat is extracted the condensed working fluid is returned to the evaporator to complete or repeat the process. In most such applications the cycle is continuous and the heat transferred determines the mass flow rate of working fluid being continuously evaporated and condensed. In thermosyphons and heat pipes the significant difference in density between the vapour travelling to the condenser and the condensate returning to the evaporator, is exploited to create a gravity return path, and in such a system the condenser must always be situated at a higher level than the evaporator. However, where the condenser and the evaporator must be at approximately the same level, for example where there is limited headroom, a pump may be used to return the condensate to the evaporator.

In operation of heat transfer devices of the kind described above it is desirable, if not essential, that the closed system contains only one working fluid, or a predefined mixture of fluids, and that no gases are present which do not condense at the working temperature of the condenser.

Of particular practical concern for many such systems is the necessity to exclude air from the cycle which, if present, would tend to collect at the condenser and reduce the efficiency of the heat transfer. Also, such air can affect the pressure/temperature characteristics of the system. In effect, a gas which is non-condensable at the condensing temperature would occupy a volume of the system which is then unavailable for latent heat transfer.

To eliminate non-condensable gases, particularly air, it is common practice to fill or charge such systems by first achieving a vacuum in the empty system before introducing the working fluid as a liquid, taking precautions to make sure air and other non-condensable gases are not introduced. The volume of working fluid introduced into the system in this manner thus defines the available vapour space. This method of charging also implies that such systems may be in a vacuum condition when cold, depending upon the saturation characteristics of the working fluid. Consequently, conditions may allow introduction of air into the system through leakage when the system is not operating. This condition will occur for many high temperature working fluids, including water, ie for working fluid which boils at atmospheric pressure at temperatures above the non-operating temperature of the system.

SUMMARY OF THE INVENTION

It is an object of the present invention to provide a closed cycle heat transfer device and method including means to compensate for expansion of a fluid vapour phase in the device whilst ensuring that non-condensable gases are not present within the system.

According to one aspect of the present invention there is provided a closed cycle heat transfer device comprising an evaporator and a condenser, a first fluid duct for transporting a heated fluid from the evaporator to the condenser, and a second fluid duct for returning condensate from the condenser to the evaporator; characterised by an expansion device connected to and in communication with the second fluid duct to receive liquid condensate therefrom thus to compensate for expansion of a fluid vapour phase in at least the first fluid duct.

The expansion device may comprise a vessel divided internally into enclosed separate chambers by a flexible membrane such that a first said chamber is in communication with the second fluid duct and a second said chamber is isolated therefrom to contain a gas.

Means may be provided to charge the second said chamber with a gas at a predetermined pressure.

Said charging means may be adapted to adjust the pressure in the second said chamber.

The evaporator may be a boiler.

The condenser may be an indirect heat exchanger connected to means for heating a working fluid in an Organic Rankine Cycle.

Means may be provided for charging the device with a working liquid.

The condenser may be disposed at an elevated level with respect to the evaporator thus to operate as a thermosyphon.

A pump may be connected to the second fluid duct to create a positive return flow of condensate to the evaporator.

One or more further condensers may be connected to the first fluid duct and, by a regulating valve second fluid duct.

According to a further aspect of the present invention there is provided a method of enabling expansion of a working fluid in a vapour phase within a closed cycle heat transfer device, the device comprising an evaporator and a condenser, a first fluid duct for transporting a heated fluid from the evaporator to the condenser and a second fluid duct for returning condensate from the condenser to the evaporator, the method comprising the steps of providing an expansion chamber connected to the second fluid duct and controlling the flow of the working fluid in a liquid phase into the expansion chamber to compensate for expansion of the working fluid vapour.

The expansion chamber may initially be charged to a first predetermined pressure whereupon a working fluid is introduced to fill the device, and the pressure is subsequently reduced in the expansion chamber to a second predetermined pressure.

The expansion chamber may be pressurised by a gas acting against one side of a flexible membrane, the opposite side of which is in communication with the working fluid in a liquid phase.

BRIEF DESCRIPTION OF THE DRAWINGS

An embodiment of the invention will now be described, by way of example, with reference to the accompanying drawings, in which.

DETAILED DESCRIPTION OF THE INVENTION

Figure 1:
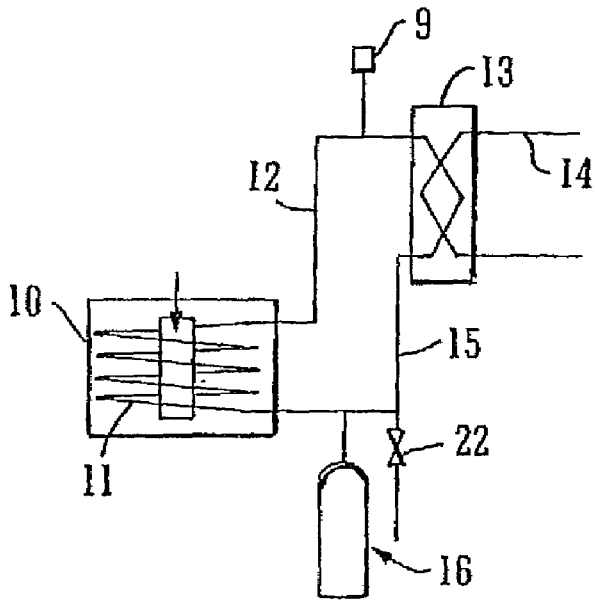
FIG. 1: is a schematic illustration of a closed cycle heat transfer device adapted to operate as a thermosyphon, in a non-operating condition.

Referring now to FIGS. 1 to 4, 6 and 7, a closed cycle heat transfer circuit comprises an evaporator in the form of a boiler 10 containing a heating coil 11 forming part of the heat transfer circuit. A first fluid duct 12 connects the output from the boiler 10 to a condenser 13 which may be adopted, for example, to heat a working fluid in an Organic Rankine Cycle circuit 14. Thus, the condenser 13 acts as an evaporator for the closed circuit of the Organic Rankine Cycle. An air vent 9 is provided in duct 12 to allow air to be evacuated if necessary.

A second fluid duct 15 is connected to the condenser 13 to return condensate to the boiler 10.

Figure 3:
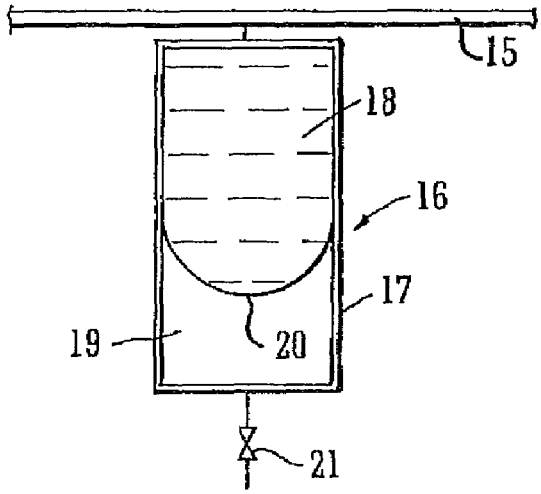
FIG. 3: is a schematic illustration of an expansion vessel forming part of the device of FIGS. 1 and 2.

Connected to the second fluid duct at a position close to the return entry port to the boiler 10 is an expansion device 16 which, as shown in FIG. 3, comprises a vessel 17 divided internally into two enclosed separate chambers 18 and 19 by a flexible membrane 20. The chamber 18 is in permanent communication with the duct 15. A valved gas charging inlet 21 communicates with the chamber 19 for a purpose to be described.

In operation, the system is initially charged with, in this example, cold water via an inlet valve 22 into the fluid duct 15, to a pressure slightly in excess of atmospheric pressure. The gas pressure within the chamber 19 is established via inlet 21 at a higher pressure than that of the water in the circuit so that the membrane 20 is in the position shown in FIG. 1. Thus, the expansion device 16 is filled with gas and contains little or no water. The pressure in the chamber 19 may be established initially at approximately 6 bar, then reduced to around 1.5 bar.

As heat is applied within the boiler 10, for example by a gas flame, the water initially increases in temperature until it reaches the boiling point corresponding to its pressure, ie, 104° C. for a pressure 1.2 bar absolute. Initially there is nowhere for the generated steam to expand and the pressure in the circuit will increase to around 1.5 bar, which is more or less equivalent to the pressure established in the chamber 19 of the expansion device. As steam is generated and as the pressure in the first duct 12 increases, so then the steam can start to fill a part of the boiler 10 and the duct 12. As soon as the steam space enters the condenser 13 heat is transferred from the duct 12 by heat exchange within the condenser, and as the heat continues to rise the steam space expands and the steam pressure rises, thus exposing more heat transfer area in the condenser 13.

Figure 2:
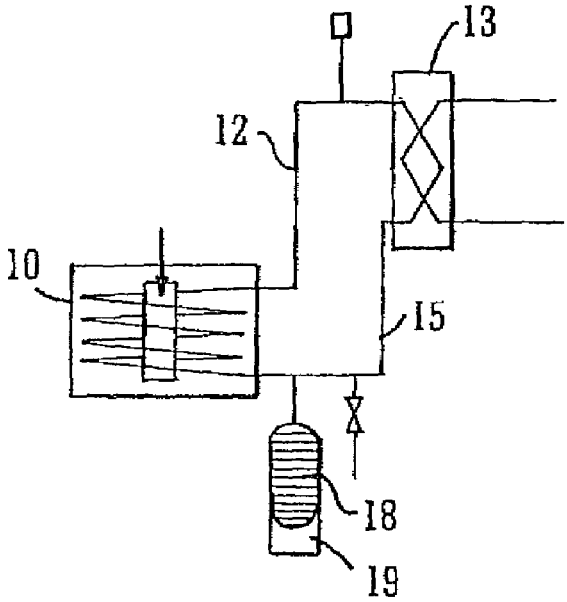
FIG. 2: shows the device in an operating condition.

As the fluid vapour phase in boiler 10, duct 12 and condenser 13 expands, so the liquid phase in duct 15 displaces the flexible membrane 20 in the expansion device 16 thus compressing the gas in chamber 19 thereof as shown in FIG. 2. The compressed gas volume in chamber 19 therefore defines the pressure reached in the fluid system such that a defined relationship is achieved between the volume of fluid displaced and the pressure in the system.

Thus, the expansion vessel provides a mechanism to displace a variable volume of working fluid to form a vapour space in the system which enables the system to be entirely filled with the working fluid in liquid form when cold at a pressure defined by the characteristics of the expansion device 16.

It is intended that when the system is not operating the pressure therein shall be at atmospheric or slightly greater, thus avoiding a vacuum condition which could encourage the ingress of air or other non-condensable gases.

When the system is operating under elevated temperature, the pressure and hence the boiling temperature of the working fluid are determined by a combination of the working fluid saturation characteristics and the pressure/volume characteristics of the expansion device.

Figure 4:
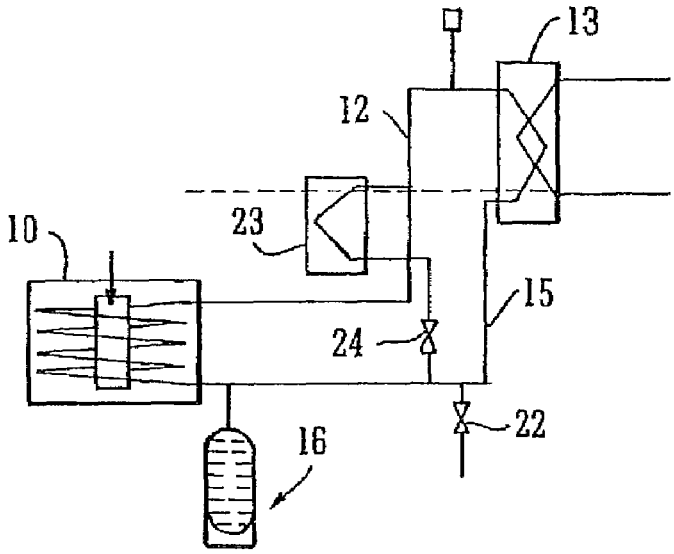
FIG. 4: shows a further embodiment of the device.

Referring now to FIG. 4, in some cases at least one further condenser 23 may be provided and connected to the ducts 12 and 15 selectively by way of a valve 24. This second condenser 23 may allow extra heat to be removed if the pressure in the circuit rises above a certain predetermined level, whereupon the valve 24 is to be opened automatically. Alternatively, this may be achieved by carefully selecting the height of the condenser 23 in relation to that of the boiler 10 and the condenser 13 so that the additional vapour space generated by the increased pressure starts to expose the heat transfer surface of the condenser 23 when the required pressure is reached. The expansion device 16 must be of such a size that sufficient steam space is exposed in the condenser 23 at the required pressure. Thus the top of the condenser 23 is preferably at or slightly above the level of the boiler and the bottom of the condenser 13. Thus, with correct positioning of the heat exchangers, the valve 24 may be omitted. In operation, as the pressure rises then an increasing amount of heat exchanger surface in the condenser 23 is exposed, thus increasing the removal of heat and providing a self-regulating system.

A second, or even a third heat exchanger may be deployed for start-up or other exceptional conditions where it is required to remove heat from the system but not to pass it to the condenser 13.

Figure 5:
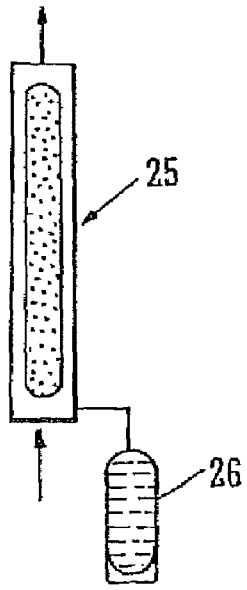
FIG. 5: is a schematic illustration of a heat pipe forming a closed cycle heat transfer device in accordance with the invention.

Referring now to FIG. 5, the physically closed loop circuit of FIGS. 1, 2 and 4 may be replaced by a so-called heat pipe in which a liquid-filled column 25 is heated at its base and useful heat is collected at its top. Within the column, heated liquid passes upwardly close to the wall of the column while cooled condensate passes downwardly through the central region, as the cycle continues.

In this embodiment also, an expansion device 26 similar to the expansion device 16 is connected to the column 25 thus to absorb excess fluid and leave adequate space for the increasing volume of the vapour phase as the heat increases.

Figure 6:
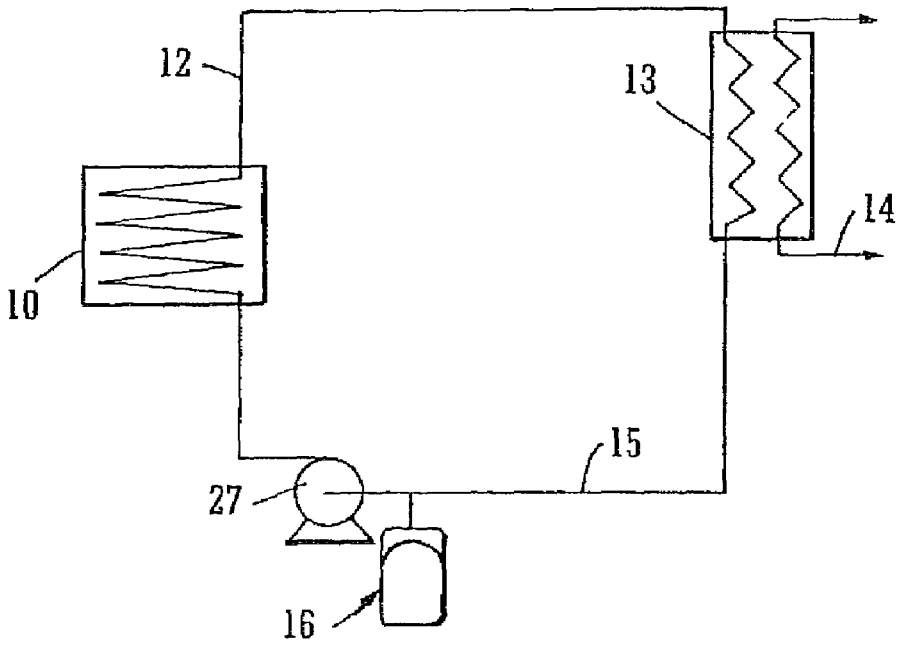
FIG. 6: shows the device equipped with a pump thus to operate other than as a thermosyphon.

Referring now to FIG. 6, if there is insufficient headroom to locate the condenser 13 at a sufficient height above the boiler 10 for a thermosyphon to operate, then a pump 27 is introduced into duct 15 to create a positive flow of condensate back into the boiler 10.

Figure 7:
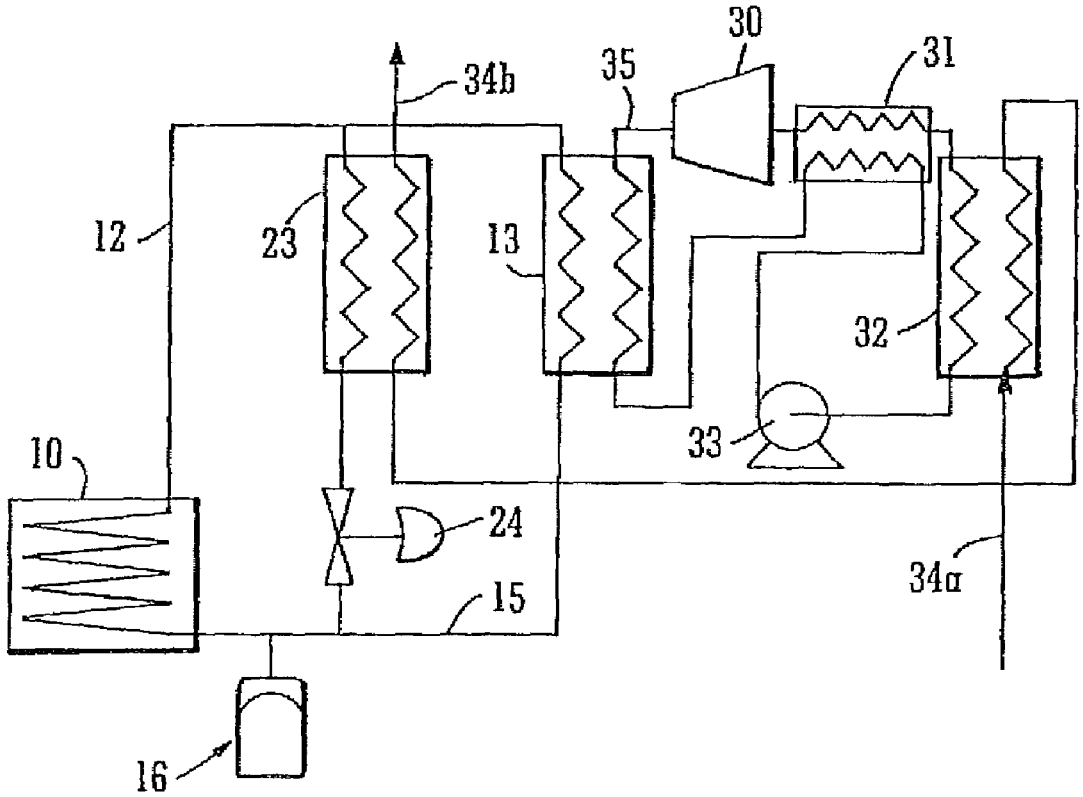
FIG. 7 shows the device for application to an Organic Rankine Cycle domestic CHP boiler

Referring now to FIG. 7, there is shown a heat transfer device connected to an Organic Rankine Cycle for supplying heat to a domestic CHP boiler (not shown). The Organic Rankine Cycle comprises the condenser 13 which serves also as an evaporator for the cycle, an expander 30, an economiser in the form a heat exchanger 31, a condenser 32, a pump 33 and heating circuit 34*a*, 34*b*.

In such a cycle the condensing steam in condenser 13 is used to evaporate an organic liquid in the duct 35 of the cycle.

The vapour produced in duct 35 then drives the expander 30 thus producing power before the low pressure vapour is condensed in condenser 32 giving out its heat to the domestic heating system 34*a*, 34*b*, and is then pumped back by pump 33 to the evaporator circuit of condenser 13.

In this example, the additional heat exchanger or economiser 31 is used to recover heat from the hot vapour leaving the expander in order to pre-heat the liquid leaving the pump 33 before it returns to the evaporator circuit of the condenser 13. As in the embodiment of FIG. 4, when the Organic Rankine Cycle has taken as much heat as it is able and the heating system requires even further heat, then additional fuel is supplied to the boiler and the pressure will increase, thus causing valve 24 connected to additional condenser 23 to open. The water which has been used to remove heat from the Organic Rankine Cycle can thus be used to remove additional heat from the condenser 23.

It will be seen that the use of an expansion device in a closed cycle heat transfer device of the kinds described, serves to take up the increase in volume of a liquid as it boils, creating a vapour space so that the heat transfer can take place effectively. The system, filled with liquid at a pressure just above atmospheric pressure when the system is cold, avoids the need for a vacuum pump or other special tools which would be needed prior to filling the system in order to remove any air or non-condensing gas. The system may be filled at or just above atmospheric pressure, and the expansion device will serve, in operation, to receive a proportion of the liquid, thus to enable efficient creation and deployment of the fluid vapour phase at the condenser.

It is not intended to limit the invention to the above specific description. For example, a liquid other than water can be used in the system, and the charging pressure selected according to the boiling temperature and saturation characteristics of the liquid.

In operation, equilibrium is achieved when sufficient temperature is attained such that the heat supplied by the boiler balances the heat taken up at the condenser. In the case of the heat pipe illustrated in FIG. 5 the liquid is likely to be a refrigerant rather than water.

The flexible membrane in the expansion devices 16 and 26 may be replaced by any other deformable or movable arrangement, such as a piston within a cylinder.

A number of advantages accrue from the provision of an expansion device in such a system, namely:

- the ability to charge a thermosyphon or similar heat transfer device in a manner which eliminates non-condensable gases such as air;
- the ability to charge such a device without the need for vacuum equipment and refrigeration engineering skills;
- the avoidance of vacuum condition when the device is not in use thus to eliminate ingress of air or other non-condensable gases;
- allowing the pressure/temperature operation defined by the working liquid saturation characteristics to increase the available heat exchanger surface area as additional heat is transferred around the device;
- exploiting the relationship between temperature, pressure and system volume, and condensate level, to enable additional heat to be directed to additional condensers when required; and
- to provide a method of limiting the maximum pressure within the device by directing excess heat to the heat exchange surface of an additional condenser so that equilibrium is reached for the maximum possible heat input.

What is now claimed:

1. A closed cycle heat transfer device comprising an evaporator and a first condenser, a first fluid duct for transporting a heated fluid from the evaporator to the first condenser, and a second fluid duct for returning condensate from the first condenser to the evaporator; by an expansion device connected to and in communication with the second fluid duct to receive liquid condensate therefrom thus to compensate for expansion of a fluid vapour phase in at least the first fluid duct, wherein at least one further condenser is connected to the first fluid duct and to the second fluid duct to receive working fluid in a vapour phase in response to a rise in pressure and temperature of the working fluid issuing from the evaporator, and the height of the further condenser is selected in relation to that of the boiler and the first condenser, so that the additional vapour space generated by the increased pressure starts to expose the heat transfer surface of the at least one further condenser when the required pressure is reached; and/or a regulating valve is disposed between the at least one further condenser and the second fluid duct.

2. The closed cycle heat transfer device according to claim 1 wherein the expansion device comprises a vessel divided internally into enclosed separate chambers by a flexible membrane such that a first said chamber is in communication with the second fluid duct and a second said chamber is isolated therefrom to contain a gas.

3. The closed cycle heat transfer device according to claim 2 including means to charge said second chamber with a gas at a predetermined pressure, and preferably wherein said charging means is adapted to adjust the pressure in the second said chamber.

4. The closed cycle heat transfer device according to claim 1 wherein the evaporator is a boiler.

5. The closed cycle heat transfer device according to claim 1 wherein the first condenser is an indirect heat exchanger connected to means for heating a working fluid in an Organic Rankine Cycle.

6. The closed cycle heat transfer device according to claim 1 including means for charging the device with a working liquid at a pressure at or slightly in excess of atmospheric pressure.

7. The closed cycle heat transfer device according to claim 1 wherein the first condenser is disposed at an elevated level with respect to the evaporator thus to operate as a thermosyphon.

8. The closed cycle heat transfer device according to claim 1 including a pump connected to the second fluid duct to return condensate to the evaporator.

9. The closed cycle heat transfer device according to claim 1 wherein the regulating valve is adapted to open and close automatically in response to changes in the pressure and temperature of the working fluid.

10. The closed cycle heat transfer device according to claim 1 wherein the or each further condenser is disposed at a level above the top of the evaporator and below the top of the first condenser.

11. The closed cycle heat transfer device according to claim 5 wherein the Organic Rankine Cycle itself comprises an evaporator, an expander, a condenser and an economiser connected between the expander and the associated condenser for recovery of heat from the expander to pre-heat the working fluid of the Organic Rankine cycle.

12. A method of operating a closed cycle heat transfer device, the device comprising an evaporator and a first condenser, a first fluid duct for transporting a heated fluid from the evaporator to the first condenser and a second fluid duct for returning condensate from the first condenser to the evaporator, and at least one further condenser connected to the first fluid duct and to the second fluid duct, the method comprising the steps of enabling expansion of a working fluid in a vapour phase within the device by providing an expansion chamber connected to the second fluid duct and controlling the flow of the working fluid in a liquid phase into the expansion chamber to compensate for expansion of the working fluid vapour; and in response to a rise in temperature of the working fluid issuing from the evaporator, causing the working fluid in a vapour phase to pass into the associated further condenser.

13. The method according to claim 12 further comprising the steps of initially charging the expansion chamber to a first predetermined pressure, introducing working fluid to fill the device and subsequently reducing the pressure in the expansion chamber to a second predetermined pressure.

14. The method according to claim 12 wherein the expansion chamber is pressurised by a gas acting against one side of a flexible membrane, the opposite side of which is in communication with the working fluid in a liquid phase.

15. The domestic heating system comprising a closed cycle heat transfer device as claimed in claim 5, wherein water circulated by the heating system removes heat from the Organic Rankine Cycle and from said at least one further condenser.

16. The method according to claim 12, wherein the device further comprises a regulating valve between said further condenser and said second fluid duct, and wherein said method further comprises causing the regulating valve to open in response to a rise in temperature of the working fluid issuing from the evaporator to thereby cause said the working fluid in a vapour phase to pass into the associated further condenser.

17. The method according to claim 12, wherein the height of the further condenser is selected in relation to that of the boiler and the first condenser, so that the additional vapour space generated by the increased pressure starts to expose the heat transfer surface of the at least one further condenser when the required pressure is reached.

* * * * *

UNITED STATES PATENT AND TRADEMARK OFFICE

CERTIFICATE OF CORRECTION

PATENT NO. : 8,141,362 B2
APPLICATION NO. : 12/421892
DATED : March 27, 2012
INVENTOR(S) : Russell Benstead and Simon Redford It is certified that error appears in the above-identified patent and that said Letters Patent is hereby corrected as shown below:

In the Specification

In column 3, line 22, “adopted” should read -- adapted --

In the Claims

In column 6, line 6, claim 1, delete “by”

In column 6, line 14, claim 1, “boiler” should read -- evaporator --

Signed and Sealed this
Eighth Day of July, 2014

Michelle K. Lee

Michelle K. Lee
*Deputy Director of the United States Patent and Trademark Office*